US006431859B1

(12) United States Patent
Neville et al.

(10) Patent No.: US 6,431,859 B1
(45) Date of Patent: Aug. 13, 2002

(54) COMBUSTION GAS AND AIR RECOVERY APPARATUS

(75) Inventors: Thomas B. Neville, Portola Valley, CA (US); Bruce E. Cain, Akron, OH (US); Brian J. Schmotzer, Cleveland Heights, OH (US); Thomas F. Robertson, Medina Township, OH (US)

(73) Assignee: North American Manufacturing Company, Cleveland, OH (US)

( * ) Notice: Subject to any disclaimer, the term of this patent is extended or adjusted under 35 U.S.C. 154(b) by 0 days.

(21) Appl. No.: 09/759,473

(22) Filed: Jan. 12, 2001

(51) Int. Cl.[7] ..... F27D 7/06
(52) U.S. Cl. ..... 432/65; 432/176
(58) Field of Search ..... 432/57, 64, 65, 432/176, 199; 34/219, 220, 221, 223, 225

(56) References Cited

U.S. PATENT DOCUMENTS

| | | | | |
|---|---|---|---|---|
| 3,604,824 A | | 9/1971 | Hardison | |
| 3,739,491 A | | 6/1973 | Creapo et al. | |
| 3,933,595 A | * | 1/1976 | Gordon et al. | 432/64 |
| 4,048,727 A | | 9/1977 | Botkins | |
| 4,140,467 A | | 2/1979 | Ellison et al. | |
| 4,206,553 A | | 6/1980 | Ellison et al. | |
| 4,250,632 A | | 2/1981 | Botkins et al. | |
| 4,457,493 A | * | 7/1984 | Takahashi | 432/199 |
| 4,663,860 A | | 5/1987 | Beall | |
| 5,150,535 A | | 9/1992 | Fleissneer | |
| 5,253,569 A | | 10/1993 | McFarlane et al. | |
| 5,568,693 A | | 10/1996 | Van den Bergen et al. | |
| 5,584,127 A | | 12/1996 | Sutherland | |
| 5,659,975 A | | 8/1997 | Bahner et al. | |
| 5,678,322 A | | 10/1997 | Potter | |
| 5,857,270 A | | 1/1999 | Bria | |
| 5,867,920 A | | 2/1999 | Rogne et al. | |
| 5,868,562 A | | 2/1999 | Watanabe et al. | |
| 6,022,389 A | | 2/2000 | Vross et al. | |
| 6,058,626 A | | 5/2000 | De Vroome et al. | |
| 6,067,726 A | | 5/2000 | Rogne et al. | |
| 6,073,368 A | | 6/2000 | Freiberg | |
| 6,095,792 A | | 8/2000 | Berger et al. | |
| 6,138,586 A | | 10/2000 | Reichart | |

OTHER PUBLICATIONS

Prior Art drawing entitled: "Schematic of Fume Incinerator with Heat Recovery Boiler for Paper Dryer".

* cited by examiner

*Primary Examiner*—Gregory A. Wilson
(74) *Attorney, Agent, or Firm*—Jones, Day, Reavis & Pogue

(57) ABSTRACT

An apparatus including a housing defining a heating process chamber. The housing has an opening communicating the process chamber to the ambient atmosphere. A burner is included that fires into a combustion chamber to heat gas. Also included is a collector structure located outside the opening. The collector structure is configured to collect air and exfiltrated gas from an outside area adjacent to the opening. The apparatus also includes a duct structure communicating the collector structure with the burner so as to supply the collected air and exfiltrated gas to the burner and thereby to supply combustion oxidant to the burner.

15 Claims, 2 Drawing Sheets

COMBUSTION GAS AND AIR RECOVERY APPARATUS

FIELD OF THE INVENTION

The present invention relates to a burner apparatus and a method of operating the burner apparatus.

BACKGROUND

A burner is known to produce oxides of nitrogen ($NO_x$) during the combustion of fuel with an oxidant. $NO_x$, is generally produced by the combination of oxygen and nitrogen molecules supplied by the oxidant. It is sometimes desirable to reduce the level of $NO_x$.

A recirculating dryer can have a process chamber in which hot gases from a burner are used to heat and dry parts. The process chamber can have open ends through which the parts to be heated and dried can be moved into and out of the process chamber. Because the ends of the process chamber are open, the hot gases used to heat and dry the parts can exfiltrated, that is, be lost to the atmosphere. Exfiltrated gas is replaced with make-up air. Also, air can infiltrate the recirculating dryer through the open ends of the process chamber and through access doors located along the length of the dryer.

Heating the infiltrated and/or make-up air from ambient temperature to the process temperature may require an increased amount of fuel to be combusted in comparison to a similar heating process that does not have infiltrated air or exfiltrated gas. An increased amount of fuel combustion may produce higher levels of $NO_x$.

SUMMARY OF THE INVENTION

The present invention provides an apparatus including a housing defining a process chamber and having an opening through which gas can exfiltrated out of the process chamber. The apparatus also includes a burner operative to fire into a combustion chamber to heat gas. A collector structure is located outside the opening. The collector structure is configured to collect air and exfiltrated gas from an outside area adjacent to the opening. A duct structure communicates the collector structure with the burner so as to supply the collected air and exfiltrated gas to the burner and thereby to supply combustion oxidant to the burner.

In a preferred embodiment, the invention can further include a blower operative to drive a flow of air across the outside area and into the collector structure such that the flow of air entrains and carries gas into the collector structure. In another preferred embodiment, the apparatus can include a plenum structure defining a plenum communicating the opening with the duct structure. The plenum structure has a first open end adjacent to the opening and a second open end remote from the opening.

The present invention defines a method including firing a burner into a combustion chamber. The method also includes directing hot gas from the combustion chamber to a process chamber. The process chamber has an opening through which gas can exfiltrated. The method further includes collecting air and exfiltrated gas from an outside area adjacent to the opening into a collector structure. Directing the air and exfiltrated gas from the collector structure through the duct structure to the burner to supply the air and exfiltrated gas as combustion oxidant to the burner is further included in the method. Additionally, the method can include directing a flow of air across the outside area, and entraining exfiltrated gas in the flow of air.

The present invention also defines a method including firing a burner into a combustion chamber. The method further includes collecting air and exfiltrated gas from an outside area adjacent to an opening into a collector structure. The method also includes directing the air and exfiltrated gas from the collector structure through the duct structure to the burner to supply the air and exfiltrated gas as combustion oxidant to the burner. Additionally, the method can include directing a flow of air across the outside area, and entraining exfiltrated gas in the flow of air.

DESCRIPTION OF PREFERRED EMBODIMENTS

Figure 1:
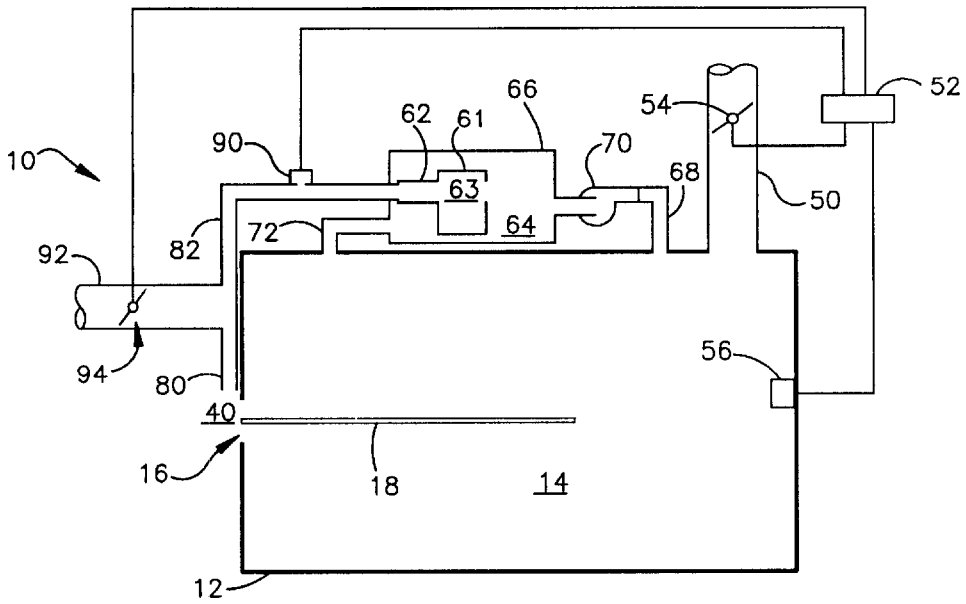
FIG. 1 is a schematic view of an apparatus comprising a first embodiment of the invention.

An apparatus 10 comprising a first embodiment of the invention is shown in FIG. 1. The apparatus 10 is a recirculating dryer. The dryer includes a housing 12 defining a process chamber 14. The process chamber 14 has an opening 16 through which workpieces 18, for example gypsum boards, one of which is shown in FIG. 1, are moved into and out of the process chamber 14. The workpieces 18 are heated and dried in the process chamber 14.

The environment inside the process chamber 14 communicates with the environment outside the process chamber 14 via the opening 16. Specifically, the opening 16 communicates the process chamber 14 with an outside area 40 adjacent to the opening 16. The process chamber 14 also has an exhaust stack 50. A control system 52 controls a valve 54 in the exhaust stack 50. A pressure sensor 56 is located in the process chamber 14 and communicates with the controller 52.

A combustion structure 61 is located adjacent to a burner 62. The burner 62 fires into a combustion chamber 63 defined by the combustion structure 61. The combustion chamber 63 communicates with a mixing chamber 64 that is defined by a heater structure 66. The burner 62 receives and subsequently combusts premix. Premix is known in the art as a mixture of fuel and oxidant. The burner 62 is a Low Emissions ($LE_x$) premix burner.

The mixing chamber 64 communicates via ductwork 68 with the process chamber 14. A blower 70 drives a flow of heated gas from the mixing chamber 64 to the process chamber 14 through the ductwork 68. Additional ductwork 72 communicates the process chamber 14 with the mixing chamber 64.

A collector structure 80 is located outside the opening 16. The collector structure 80 shown in FIG. 1 is an open-end portion of a duct structure 82. The duct structure 82 communicates the collector structure 80 with the burner 62. An oxygen sensor 90 is located in the duct structure 82 and communicates with the controller 52. An air inlet 92 communicates with the duct structure 82. A valve 94 is located in the air inlet 92 and communicates with the controller 52.

During operation of the apparatus 10, the workpieces 18 are moved into the process chamber 14. Premix is supplied to the burner 62, which then fires into the combustion chamber 63 to heat gas in the mixing chamber 64. The heated gas is supplied to the process chamber 14 through the ductwork 68 under the influence of the blower 70. While in the process chamber 14, the heated gas flows over and dries the workpieces 18. The gas is recirculated from the process chamber 14 to the mixing chamber 64 through the ductwork 72.

The control system 52 monitors the pressure in the process chamber 14 with the pressure sensor 56 as known in the art. The control system 52 maintains the pressure in the process chamber 14 in a range of predetermined pressure values. In order to maintain the pressure in the process chamber 14, the control system 52 opens or closes the valve 54 in the exhaust stack 50.

Opening the valve 54 allows gas from the process chamber 14 to leave through the stack 50 and subsequently decreases the pressure in the process chamber 14. Outside air can flow into the process chamber 14, i.e. infiltrate, through the opening 16 when the pressure outside of the process chamber 14 is higher than the pressure inside the process chamber 14. This can disrupt temperature uniformity in the process chamber 14. Infiltrating air can also have the undesirable effect of adding mass that must be heated to the process temperature. Thus, it may be desirable to operate the process chamber 14 at a higher internal pressure to decrease the amount of infiltrating air.

Closing the valve 54 prevents gas in the process chamber 14 from leaving through the stack 50 and subsequently increases the pressure in the process chamber 14. As the pressure in the process chamber 14 increases, the amount of air infiltrating through the opening 16 is reduced. In addition, a higher pressure in the process chamber 14 relative to the pressure outside the process chamber 14 can cause some of the gas in the process chamber 14 to flow out through the opening 16, i.e. exfiltrated, to the outside area 40 adjacent to the opening 16. Additionally, heated gas can be carried out of the process chamber 14 by workpieces 18 that are leaving the process chamber 14 through the opening 16.

The present invention can capture exfiltrated gas in the collector structure 80. In this embodiment, collection is accomplished by a natural draft that draws air and exfiltrated gas into the collector structure 80. From the collector structure 80, the gas is directed by the duct structure 82 to the burner 62. The exfiltrated gas and air provides combustion oxidant to the burner 62. In this manner the heat energy of the exfiltrated gas, and the oxidant content of the exfiltrated gas, is captured and returned to the recirculating dryer. The decreased amount of mass to be heated can result in a decreased amount of fuel combustion necessary to maintain a predetermined temperature in the process chamber 14.

The collected exfiltrated gas can have non-combustible components. The non-combustible components dilute the combustion oxidant in the exfiltrated gas. Therefore, by directing the exfiltrated gas back through the burner 62, the diluted combustion oxidant is provided to the burner 62. The use of diluted combustion oxidant can provide a flame lower in temperature than a flame utilizing undiluted combustion oxidant. The lower temperature flame can produce a lower level of $NO_x$ than a similar higher temperature flame.

The oxygen sensor 90 senses the oxygen content of the collected exfiltrated gas as it is directed through the duct structure 82. The oxygen sensor 90 communicates the oxygen content information with the controller 52. The controller 52 can open and close the valve 94 in the air inlet 92 to increase or decrease the amount of air entering the duct structure 82. This can increase or decrease the oxygen content in the collected exfiltrated gas being directed through the duct structure 82. In this manner, the controller 52 maintains a supply of collected exfiltrated gas having a predetermined oxygen content to the burner 62.

Figure 2:
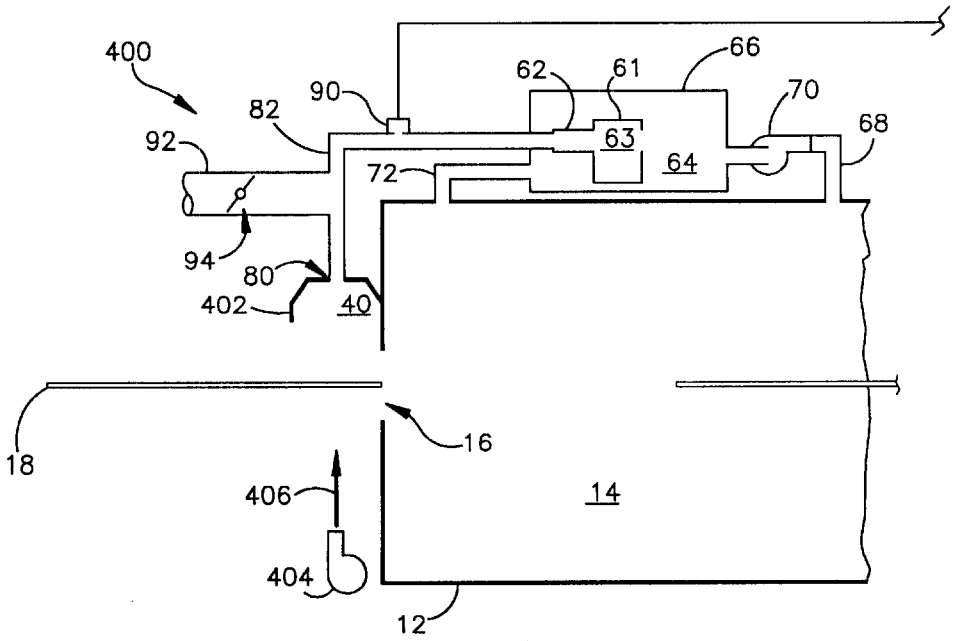
FIG. 2 is a schematic view of an apparatus comprising a second embodiment of the invention.

An apparatus 400 comprising a second embodiment the invention is shown in FIG. 2. The apparatus 400 has many parts that are substantially the same as corresponding parts of the apparatus 10 described above. This is indicated by the use of the same reference numbers for such corresponding parts in FIGS. 1 and 2. However, the collector structure 80 in the apparatus 400 includes a hood 402. The hood 402 is located over the opening 16. A curtain blower 404 is located underneath the opening 16 and is oriented to direct a curtain flow of air 406 across the opening 16 and to the hood 402. The hood 402 is configured to collect the air and exfiltrated gas from the area 40.

During operation, the curtain blower 404 provides the flow of air 406 extending across the area 40. The flow of air 406 entrains the exfiltrated gas that is in the area 40. The entrained, exfiltrated gas is directed by the flow of air 406 under the influence of the blower 404 to the hood 402. The hood 402 collects the entrained, exfiltrated gas and directs it through the duct structure 82 to the burner 62.

Figure 3:
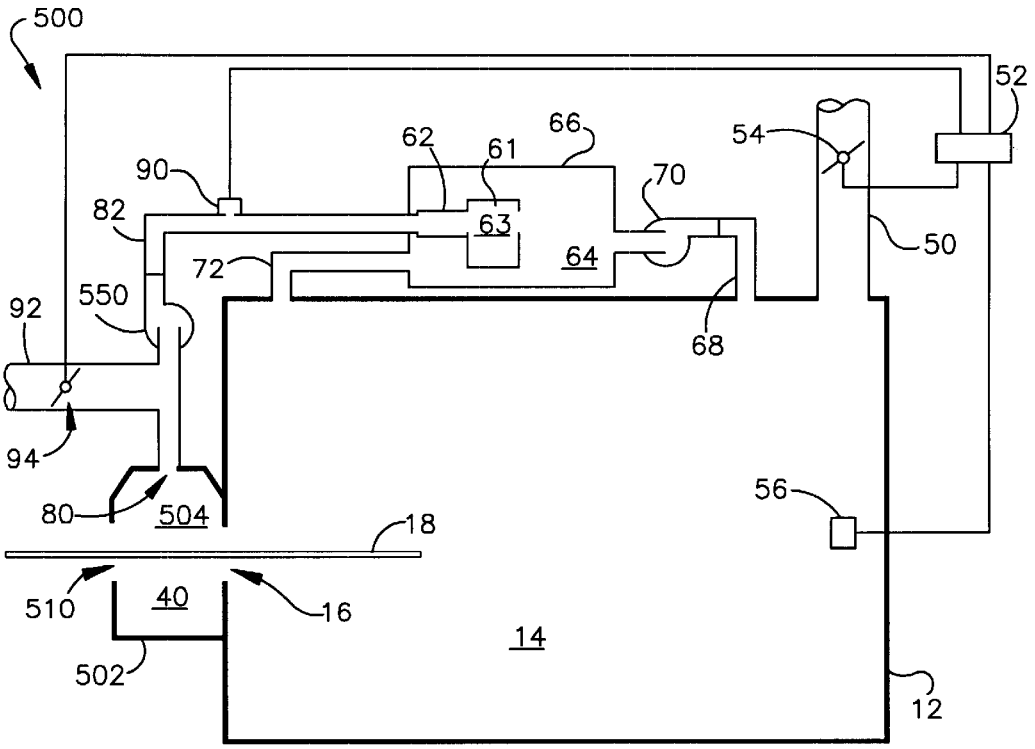
FIG. 3 is a schematic view of an apparatus comprising a third embodiment of the present invention.

An apparatus 500 comprising a third embodiment the invention is shown in FIG. 3. The apparatus 500 likewise has many parts that are substantially the same as corresponding parts of the apparatus 10 described above. This is indicated by the use of the same reference numbers for such corresponding parts in FIGS. 1 and 3. However, the collector structure 80 in the apparatus 500 includes a plenum structure 502 defining a plenum 504 that comprises the area 40. An entrance 510 to the plenum 504 is located remote from the opening 16. The duct structure 82 is equipped with a blower 550 located in the duct structure 82.

During operation, the plenum 504 receives air moving through the entrance 510 from the ambient atmosphere and directs it to the duct structure 82. The plenum 504 also receives gas exfiltrated through the opening 16 and directs it to the duct structure 82. The duct structure 82 directs exfiltrated gas and air from the plenum 504 to the burner 62 to supply combustion oxidant to the burner 62.

Operation of the blower 550 induces a flow in the duct structure 82 from the plenum 504 to the burner 62. This can also lower the pressure in the plenum 504 relative to the pressure in the process chamber 14. Lowering the relative pressure can increase the amount of gas flowing from the process chamber 14 into the plenum 504 through the opening 16. In this manner, an increased amount of gas from the process chamber 14 can be supplied to the burner 62 to provide combustion oxidant to the burner.

Figure 4:
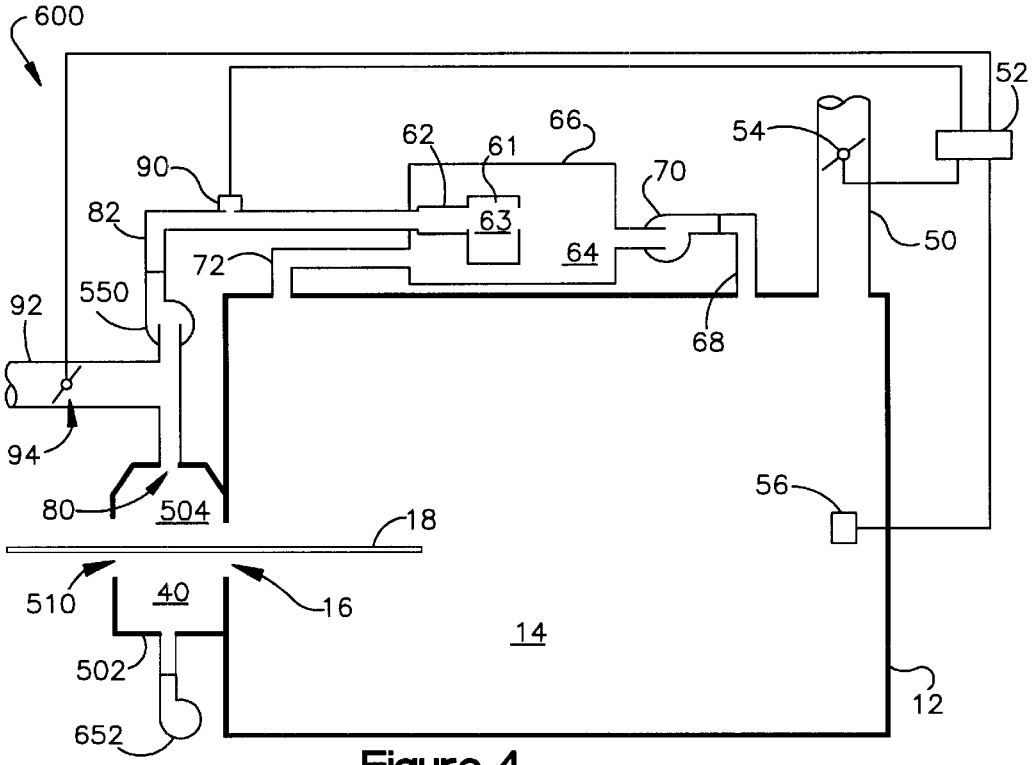
FIG. 4 is a schematic view of an apparatus comprising a fourth embodiment of the present invention.

An apparatus 600 comprising a fourth embodiment the invention is shown in FIG. 4. The apparatus 600 has many parts that are substantially the same as corresponding parts of the apparatus 500 described above. This is indicated by the use of the same reference numbers for such corresponding parts in FIGS. 3 and 4. However, the apparatus 600 is further equipped with a blower 652 communicating with the plenum 504.

During operation, the blower 652 increases the pressure in the plenum 504. The increase of the plenum 504 pressure reduces the flow of gas from the process chamber 14 into the plenum 504. The pressure increase in the plenum 504 also reduces the flow of air into the plenum 504 from the ambient atmosphere through the entrance 510.

Although preferred embodiments of the invention have been shown and described, it should be understood that various modifications and substitutions, as well as rearrangements and combinations, can be made by those skilled in the art, without departing from the spirit and scope of this invention.

What is claimed is:

1. An apparatus comprising:

a) a housing defining a process chamber and having an opening through which gas can exfiltrated said process chamber:

b) a combustion structure defining a combustion chamber communicating with said process chamber;

c) a burner operative to fire into said combustion chamber;

d) a collector structure located outside said opening, said collector structure being configured to collect air and exfiltrated gas from an outside area adjacent to said opening;

e) a duct structure communicating said collector structure with said burner so as to supply said collected air and exfiltrated gas to said burner and thereby to supply combustion oxidant to said burner; and f) a blower operative to drive a flow of said air across said outside area and into said collector structure such that said flow of said air entrains and carries said exfiltrated gas into said collector structure.

2. An apparatus comprising:

a) a housing defining a process chamber and having an opening through which gas can exfiltrate said process chamber;

b) a combustion structure defining a combustion chamber communicating with said process chamber;

c) a burner operative to fire into said combustion chamber;

d) a collector structure located outside said opening, said collector structure being configured to collect air and exfiltrated gas from an outside area adjacent to said opening; and e) a duct structure communicating said collector structure with said burner so as to supply said collected air and exfiltrated gas to said burner and thereby to supply combustion oxidant to said burner;

wherein said collector structure includes a hood.

3. An apparatus comprising:

a) a housing defining a process chamber and having an opening through which gas can exfiltrate said process chamber;

b) a combustion structure defining a combustion chamber communicating with said process chamber;

c) a burner operative to fire into said combustion chamber;

d) a collector structure located outside said opening, said collector structure being configured to collect air and exfiltrated gas from an outside area adjacent to said opening; and e) a duct structure communicating said collector structure with said burner so as to supply said collected air and exfiltrated gas to said burner and thereby to supply combustion oxidant to said burner;

wherein said process chamber is a recirculating drying chamber.

4. An apparatus comprising:

a) a housing defining a process chamber and having an opening through which gas can exfiltrate said process chamber;

b) a combustion structure defining a combustion chamber communicating with said process chamber;

c) a burner operative to fire into said combustion chamber;

d) a collector structure located outside said opening, said collector structure being configured to collect air and exfiltrated gas from an outside area adjacent to said opening; and e) a duct structure communicating said collector structure with said burner so as to supply said collected air and exfiltrated gas to said burner and thereby to supply combustion oxidant to said burner;

wherein said opening is configured to allow workpieces to move through.

5. An apparatus comprising:

a) a housing defining a process chamber and having an opening through which gas can exfiltrate said process chamber;

b) a combustion structure defining a combustion chamber communicating with said process chamber;

c) a burner operative to fire into said combustion chamber;

d) a collector structure located outside said opening, said collector structure being configured to collect air and exfiltrated gas from an outside area adjacent to said opening;

e) a duct structure communicating said collector structure with said burner so as to supply said collected air and exfiltrated gas to said burner and thereby to supply combustion oxidant to said burner;

f) a plenum structure defining a plenum communicating said opening with said duct structure, said plenum structure having a first open end adjacent to said opening and a second open end remote from said opening; and g) an additional blower which communicates with said plenum and which is operative to increase the pressure in said plenum.

6. An apparatus comprising:

a) a housing defining a process chamber and having an opening through which gas can exfiltrate said process chamber;

b) a burner operative to fire into a combustion chamber to heat gas;

c) a collector structure located outside said opening, said collector structure being configured to collect air and exfiltrated gas from an outside area adjacent to said opening;

d) a duct structure communicating said collector structure with said burner so as to supply said collected air and exfiltrated gas to said burner and thereby to supply combustion oxidant to said burner; and e) a blower operative to drive a flow of air across said outside area and into said collector structure such that said flow of air entrains and carriers said exfiltrated gas into said collector structure.

7. An apparatus comprising:

a) a housing defining a process chamber and having an opening through which gas can exfiltrate said process chamber;

b) a burner operative to fire into a combustion chamber to heat gas;

c) a collector structure located outside said opening, said collector structure being configured to collect air and exfiltrated gas from an outside area adjacent to said opening; and d) a duct structure communicating said collector structure with said burner so as to supply said collected air and exfiltrated gas to said burner and thereby to supply combustion oxidant to said burner;
wherein said collector structure includes a hood.

8. An apparatus comprising:

a) a housing defining a process chamber and having an opening through which gas can exfiltrate said process chamber;

b) a burner operative to fire into a combustion chamber to heat gas;

c) a collector structure located outside said opening, said collector structure being configured to collect air and exfiltrated gas from an outside area adjacent to said opening; and d) a duct structure communicating said collector structure with said burner so as to supply said collected air and exfiltrated gas to said burner and thereby to supply combustion oxidant to said burner;
wherein said process chamber is a recirculating drying chamber.

9. An apparatus comprising:

a) a housing defining a process chamber and having an opening through which gas can exfiltrate said process chamber;

b) a burner operative to fire into a combustion chamber to heat gas;

c) a collector structure located outside said opening, said collector structure being configured to collect air and exfiltrated gas from an outside area adjacent to said opening; and d) a duct structure communicating said collector structure with said burner so as to supply said collected air and exfiltrated gas to said burner and thereby to supply combustion oxidant to said burner;
wherein said opening is configured to allow workpieces to move through.

10. An apparatus comprising:

a) a housing defining a process chamber and having an opening through which gas can exfiltrate said process chamber;

b) a burner operative to fire into a combustion chamber to heat gas;

c) a collector structure located outside said opening, said collector structure being configured to collect air and exfiltrated gas from an outside area adjacent to said opening;

d) a duct structure communicating said collector structure with said burner so as to supply said collected air and exfiltrated gas to said burner and thereby to supply combustion oxidant to said burner;

e) a plenum structure defining a plenum communicating said opening with said duct structure, said plenum structure having a first open end adjacent to said opening and a second open end remote from said opening; and d) an additional blower which communicates with said plenum and which is operative to increase the pressure in said plenum.

11. An apparatus comprising:

a) a housing defining a process chamber and having an opening through which gas can exfiltrate said process chamber;

b) a combustion structure defining a combustion chamber communicating with said process chamber;

c) a collector structure located outside said opening, said collector structure being configured to collect air and exfiltrated gas from an outside area adjacent to said opening;

d) a premix burner operative to mix said collected air and exfiltrated gas with fuel to create premix and to fire said premix into said combustion chamber; and e) a duct structure communicating said collector structure with said burner so as to supply said collected air and exfiltrated gas to said burner.

12. A method of operating an apparatus comprising a process chamber having an opening through which gas can exfiltrate the process chamber, a combustion chamber communicating with the process chamber, and a premix burner operative to fire into the combustion chamber, said method comprising:

a) collecting air and exfiltrated gas from an outside area adjacent to the process chamber opening;

b) directing the collected air and exfiltrated gas to the premix burner to supply the premix burner with combustion oxidant from the collected air and exfiltrated gas;

c) mixing said collected air and exfiltrated gas with fuel in the premix burner to form premix; and d) firing the premix burner into the combustion chamber.

13. An apparatus comprising:

a) a housing defining a process chamber and having an opening through which gas can exfiltrate said process chamber;

b) a combustion structure defining a combustion chamber communicating with said process chamber;

c) a burner operative to fire into said combustion chamber;

d) an air inlet structure with an air inlet valve;

e) a collector structure located outside said opening, said collector structure being configured to collect air and exfiltrated gas from an outside area adjacent to said opening; and f) a duct structure communicating said air inlet structure and said collector structure with said burner so as to supply said burner with combustion oxidant from said air inlet structure, from the ambient atmosphere outside said opening, and from said process chamber within said opening.

14. An apparatus as defined in claim 13 further comprising a plenum structure defining a plenum communicating said opening with said collector structure, said plenum structure having a first open end adjacent to said opening and a second open end communicating with the ambient atmosphere.

15. A method of operating an apparatus comprising a process chamber having an opening through which gas can exfiltrate the process chamber, a combustion chamber communicating with the process chamber, a premix burner operative to fire into the combustion chamber, and an air inlet structure with an air inlet valve, said method comprising:

a) collecting air and exfiltrated gas from an outside area adjacent to the process chamber opening; and b) directing said collected air and exfiltrated gas, and also air from the air inlet structure, to the burner so as to supply the burner with combustion oxidant from the air inlet structure, from the ambient atmosphere outside the opening, and from the process chamber within the opening.

* * * * *

UNITED STATES PATENT AND TRADEMARK OFFICE

CERTIFICATE OF CORRECTION

PATENT NO. : 6,431,859 B1 
DATED : August 13, 2002
INVENTOR(S) : Thomas B. Neville, Bruce E. Cain, Brian J. Schmotzer and Thomas F. Robertson It is certified that error appears in the above-identified patent and that said Letters Patent is hereby corrected as shown below:

Column 5,
Line 8, change "exfiltrated" to -- exfiltrate --

Signed and Sealed this

Twenty-first Day of January, 2003

JAMES E. ROGAN
*Director of the United States Patent and Trademark Office*